US005191680A

United States Patent [19]

Kaneko et al.

[11] Patent Number: 5,191,680

[45] Date of Patent: Mar. 9, 1993

[54] FILAMENT THREADING IN AN AIR GUN FOR PRODUCING NONWOVEN FABRICS

[75] Inventors: Akira Kaneko; Nobuo Higashiya; Hiroyuki Hamasuna, all of Kuga, Japan

[73] Assignee: Mitsui Petrochemical Industries, Ltd., Tokyo, Japan

[21] Appl. No.: 748,806

[22] Filed: Aug. 22, 1991

[30] Foreign Application Priority Data

Aug. 27, 1990 [JP] Japan ..... 2-224753

[51] Int. Cl.[5] ..... D01G 25/00

[52] U.S. Cl. ..... 19/299; 19/308; 28/272; 28/273; 226/97

[58] Field of Search ..... 19/299, 304, 308, 273; 28/273, 164, 271, 272, 274, 276; 65/5; 57/263, 908; 156/167; 264/177.13, 209.8, 555; 226/97

[56] References Cited

U.S. PATENT DOCUMENTS

| | | | |
|---|---|---|---|
| 2,455,174 | 11/1948 | Hitt | 19/299 X |
| 3,156,752 | 11/1964 | Cope | 19/299 X |
| 3,802,038 | 4/1974 | Bauch et al. | 28/273 X |
| 4,095,312 | 6/1978 | Haley | 19/308 |
| 4,202,855 | 5/1980 | Gerking et al. | 19/299 X |
| 4,322,027 | 3/1982 | Reba | 19/299 X |
| 4,340,563 | 7/1982 | Appel et al. | 19/299 X |
| 4,346,504 | 8/1982 | Birk et al. | 19/299 X |
| 4,964,197 | 10/1990 | Mente et al. | 19/299 |

*Primary Examiner*—Andrew M. Falik
*Assistant Examiner*—Ismael Izaguirre

[57] ABSTRACT

An air gun for producing nonwoven fabrics has an inlet, a carrier path and a compressed air blow port. The air gun receives filaments spun from high speed spinning nozzles and delivers them onto a screen belt to form a web. The inlet of the air gun receives the filament from the spinning nozzle. The carrier path then puts the filament on an air flow to deliver it while the compressed air blow port is open in the midst of the carrier path to an air inlet from a compressed air source. On a downstream side of the carrier path from the compressed air blow port an exhaust path is provided. When the filament is introduced into the inlet of the air gun, a part of the air flowing into the carrier path is discharged from this exhaust path. Because the exhaust path remains open during filament introduction, a negative pressure at the filament inlet increases thereby sucking the filaments into the inlet. The exhaust path can then be closed and the filaments will be drawn and delivered under constant traction.

13 Claims, 3 Drawing Sheets

FILAMENT THREADING IN AN AIR GUN FOR PRODUCING NONWOVEN FABRICS

BACKGROUND OF THE INVENTION

1. Field of the Invention

The present invention relates to an air gun for producing nonwoven fabrics, and particularly to an air gun for producing nonwoven fabrics in which at the start of operation, a filament can be easily introduced.

2. Description of the Related Art

As an air gun producing nonwoven fabrics, particularly, an air gun for drawing and receiving filaments spun from spinning nozzles at high speed and putting them on an air flow and delivering them onto a screen belt to form a web which is intermediate of nonwoven fabric, there has been heretofore proposed a configuration which includes an inlet for receiving filaments spun from spinning nozzles, a carrier path for putting said filaments introduced through said inlet to deliver them, and a compressed air blow port which is opened in the midst of said carrier path to jet air from a compressed air source into the carrier path.

In such an air gun as described, more specifically, an accelerating pipe constituting a part of the carrier path is connected on the downstream side.

When compressed air is blown out of the compressed air blow port, a negative pressure is generated in the filament inlet to suck filaments from the spinning nozzle (hereinafter referred to as an ejector performance). In addition, when compressed air is blown out of the compressed air blow port, a traction is applied to the filament downstream from that portion to draw and deliver the filament (hereinafter referred to as a receiving performance).

In such an air gun as described, it is desirable for economical operation and prevention of noises caused by air to maintain the receiving performance and reduce an amount of drive air.

As the method for maintaining the receiving performance and reducing the amount of drive air, a method for reducing an inside diameter of an accelerating pipe to increase flow velocity within the pipe is employed.

However, if the inside diameter of the accelerating pipe is reduced, pressure loss increases, and pressure of filament inlet increases by that portion to deteriorate the ejector performance and make it difficult to introduce filaments at the start of operation.

SUMMARY OF THE INVENTION

It is an object of the present invention to provide an air gun for producing nonwoven fabrics, which is designed so that at the start of operation, filaments spun from a spinning nozzle are easily introduced into an inlet of the air gun.

The air gun for producing nonwoven fabrics according to the present invention comprises an inlet for receiving filaments spun from a spinning nozzle, a carrier path for putting the filaments introduced from the inlet on an air flow to deliver them, and a compressed air blow port opened in the midst of the carrier path to jet air being fed from a compressed air source into the carrier path.

According to a control method for an air gun for producing nonwoven fabrics of the present invention, an exhaust path is provided in said carrier path downstream from said compressed air blow port, and when filaments spun from the spinning nozzle are introduced into the inlet of the air gun, a part of air flowing from the exhaust path into the carrier path is discharged.

The air gun for producing nonwoven fabrics of the present invention for realizing the aforesaid method comprises an inlet for receiving filaments spun from a spinning nozzle, a carrier path for putting said filaments introduced from the inlet on an air flow to deliver them, a compressed air blow port opened in the midst of the carrier path to jet air being fed from a compressed air source into the carrier path, and an exhaust path branched from the carrier path downstream from said compressed air blow port to remove a part of air flowing in the carrier path, said exhaust path capable of being opened and closed.

Synthetic resins to be spun by use of an air gun for producing nonwoven fabrics according to the present invention include, for example, polyolefine such as polyethylene, polypropylene, etc.; or ethylene vinyl compound copolymers such as an ethylene vinyl chloride copolymer; styrene resins; vinyl chloride resins such as polyvinyl chloride, polyvinylidene chloride, etc; polyacrylic ester; polyamide; polyester such as polyethylene terephthalate, and other synthetic resins that may be spun. These may be used in the form of a single or in the form of a mixture. A suitable amount of inorganic pigments or organic pigments may be blended into the synthetic resins.

A bundle of spun filaments is introduced into the air gun of the present invention, drawn by an air flow and blown against a collecting surface to form a web.

Usually, a plurality of air guns are arranged since nonwoven fabrics having a practicable width are formed.

When filaments are introduced into an inlet of the air gun, the exhaust path remains opened. In this state, a negative pressure at the filament inlet increases, and the filaments are sucked into the inlet merely by moving the filaments close to the inlet of the air gun.

Thereafter, the exhaust path is closed, and the filaments are drawn and delivered under constant traction.

According to the present invention, when the filaments are introduced into the inlet of the air gun, the exhaust path is opened whereby the negative pressure of the filament inlet can be increased to facilitate the introduction of the filaments. Thereafter, the exhaust path is closed under normal operation, and the filaments can be drawn and delivered with sufficient traction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a half sectional view of the entire air gun;

FIG. 2 is a sectional view partly enlarged; and

FIG. 3 is a schematic view of the entire apparatus for producing nonwoven fabrics provided with an air gun.

DESCRIPTION OF THE PREFERRED EMBODIMENTS

Figure 2:
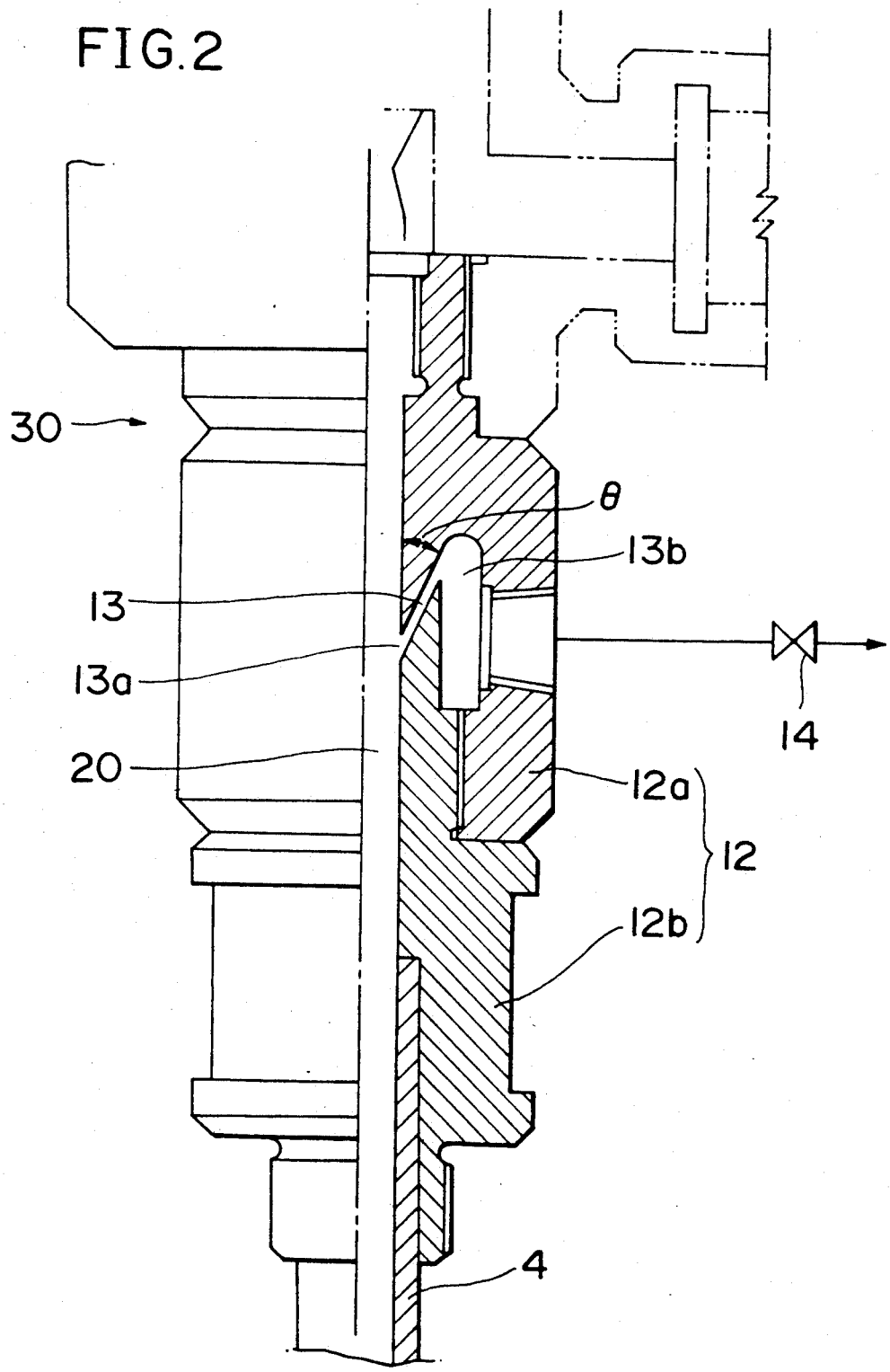
Figure 3:
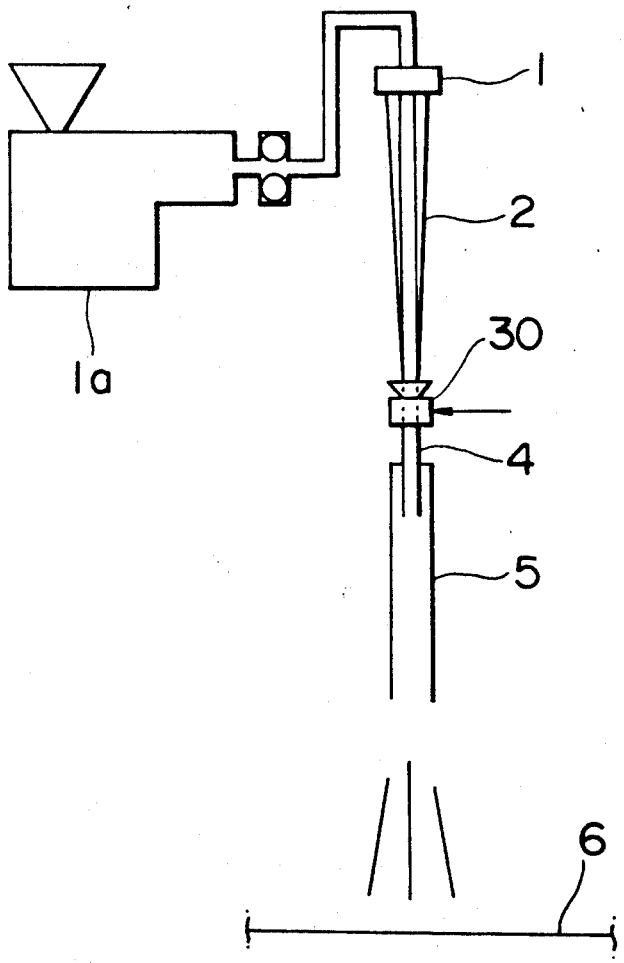

An embodiment of the present invention will be described with reference to FIGS. 1 to 3.

Figure 1:
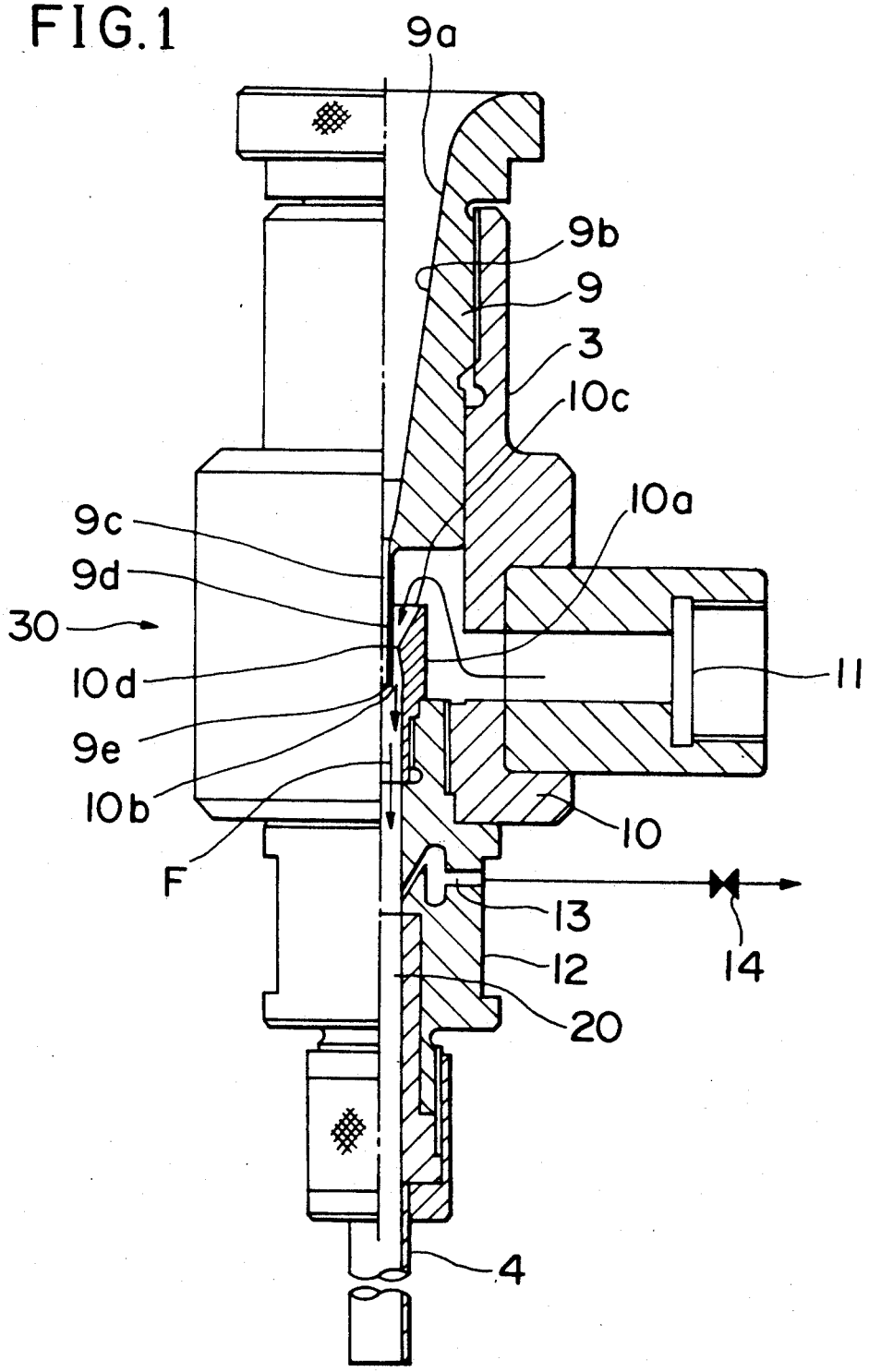
FIGS. 1 to 3 show embodiments of the present invention.

An air gun for producing nonwoven fabrics 30 in this embodiment has a construction as shown in FIG. 1. The air gun 30 comprises an inlet 9*a* for receiving a filament 2 delivered from a spinning nozzle 1 shown in FIG. 3, an outlet 9*e* for delivering the filament 2 introduced from the inlet 9*a*, a compressed air inlet 11 and a compressed air blow port 10*b*, said compressed air blow port 10*b* being positioned in the periphery of the filament outlet 9*e* to blow out compressed air from the outlet 10*b*, and further comprises an air nozzle 3 for delivering a filament from the filament outlet 9*e* while drawing it, a connection pipe 12 connected on the side of the outlet 9*e* of the air nozzle 3 and an accelerating pipe 4 connected to the connection pipe 12 to guide and deliver the filament 2.

A carrier path 20 for carrying the filament 2 is formed passing through the outlet 9*e*, the connection pipe 12 and an accelerating pipe 4 from the inlet 9*a* of the air nozzle 3. An exhaust path 13 is formed in the connection pipe 12.

This embodiment will be described hereinafter in more detail.

There are provided an air nozzle 3 for receiving a filament 2 spun from a spinneret 1 which is a collective body of spinning nozzles, an accelerating pipe 4 connected to the air nozzle 3 through a connection pipe 12, and a guide tube 5 connected to an extreme end of the accelerating pipe 4.

Connected to the extreme end of the guide tube 5 is a separator nozzle (not shown) for scattering the filament 2 delivered together with compressed air toward a screen belt 6. The filament 2 scattered by the separator nozzle is accumulated on the screen belt 6 to form a web.

The spinneret 1 as the collective body of spinning nozzles comprises nine sets each consisting of 108 small holes each having a diameter of 0.85 mm per section, and spinning is accomplished with molten resin extruded out of an extruder 1*a*.

As shown in FIG. 1, the air nozzle 3 is composed of a first nozzle 9, and second nozzle 10 connected to the first nozzle 9.

The first nozzle 9 has a filament inlet 9*a* for receiving the filament 2 delivered from the spinneret 1, and the interior continuous to the filament inlet 9*a* includes a tapered pipeline 9*b* reduced in diameter to a middle portion toward the extreme end and a straight pipeline 9*c* having the same diameter from the extreme end of the tapered pipeline 9*b* to a filament outlet 9*e*. This straight pipeline 9*c* is formed from a nozzle pipe 9*d* which is projected.

The second nozzle 10 is connected to the first nozzle 9 so as to encircle the periphery of the extreme end of the nozzle pipe 9*d*. The second nozzle 10 has a blow nozzle 10*a* which encircles the extreme end of the nozzle pipe 9*d*. A slight clearance is formed between the inner surface of the blow nozzle 10*a* and the outer surface of the nozzle pipe 9*d* to form a compressed air blow port 10*b* around the filament outlet 9*e* at the extreme end of the nozzle pipe 9*d*. The inner surface of the blow nozzle 10*a* is gradually reduced in diameter from the air inlet 10*c*, is gradually increased in diameter behind the maximum constriction 10*d* in the midst, and thereafter assumes a straight pipeline having the same diameter from a portion corresponding to the filament outlet 9*e*.

On the other hand, a compressed air inlet 11 is provided on the side of the second nozzle 10, said compressed air inlet 11 being communicated with the air inlet 10*c* of the blow nozzle 10*a*. Air introduced from the compressed air inlet 11 into the blow nozzle 10*a* increases its flow velocity the the maximum at a point passing through the maximum constriction 10*d* of the minimum inside diameter, whereby air is jetted strongly in a direction as indicated by arrow F from the compressed air blow port 10*b* to strongly draw the filament 2 passing near the center of the nozzle pipe 9*d*.

A connection pipe 12 is connected to the second nozzle 10 in a direction of delivering the filament 2, an accelerating pipe 4 for guiding the filament 2 is connected to the connection pipe 12, and a guide tube 5 is connected to the extreme end of the accelerating pipe 4.

The connection pipe 12 is formed with an exhaust path 13, said exhaust path 13 extending to be inverted at an angle 30 degrees ($\theta$) with respect to the axial direction of the connection pipe 12 from an exhaust port 13*a* opened to the inner surface of the connection pipe 12 to the upstream side of air (upstream side the carrier path) and continuous to an air reservoir 13*b*. A closing valve 14 is provided in the midst of the exhaust path 13 continuous to the air reservoir 13*b* to open and close the exhaust path 13. In FIG. 2, the second connection pipe 12*b* is connected to the first connection pipe 12*a*, the connection pipe 12*a* being formed with the exhaust path 13, and the accelerating pipe 4 is connected at the second connection pipe 12*b*.

The angle $\theta$ extended from the exhaust port 13*a* so that the exhaust path 13 is inverted toward the upstream with respect to the carrier path 20 is preferably 15 to 75 degrees. While the clearance of the exhaust port 13*a* used is 1 mm, it is to be noted that a clearance in the range from 0.5 mm to 2.0 mm is preferred. In this way, the amount of drive air can be reduced and the receiving performance can be maintained without the filament being caught in the exhaust port 13*a*. The accelerating pipe 4 used has 6 mmϕ of inside diameter and 540 mm of length.

The guide tube 5 is provided to guide the filament 2 to the separator nozzle not shown, and the separator nozzle is connected to the extreme end of the guide tube 5.

The separator nozzle is provided to scatter the filament 2 delivered together with the compressed air from the accelerating pipe 4 toward the screen belt 6.

The air gun for producing nonwoven fabrics 30 constructed as described above was used and the exhaust path 13 was opened and closed to measure the amount of drive air, a degree of vacuum at the filament inlet 9*a*, the suction amount of air at the filament inlet 9*a* and the readiness of introduction of the filament 2 into the filament inlet 9*a*. A nylon monofilament having 520 μm of diameter was inserted by 700 mm into the air gun from the filament inlet 9*a* and tension applied thereto was measured. The results are shown in Table 1.

TABLE 1

| Embodiment | 1 | | 2 | | 3 | |
|---|---|---|---|---|---|---|
| Exhaust path | Open | Closed | Open | Closed | Open | Closed |
| Amount of air escape | 7.8 | 0 | 7.9 | 0 | 7.8 | 0 |

TABLE 1-continued

| Embodiment | 1 | | 2 | | 3 | |
|---|---|---|---|---|---|---|
| Amount of drive air | 33 | 33 | 27 | 27 | 23 | 23 |
| Tension (g) | 20 | 32 | 16 | 26 | 15 | 22 |
| Degree of vacuum at inlet | 620 | 180 | 620 | 200 | 640 | 230 |
| Suction amount at inlet | 4.6 | 0.8 | 5.1 | 1.4 | 4.6 | 1.8 |
| Readiness of introduction | ○ | X | ○ | X | ○ | X |

In Table 1 above, units of the amount of air escape, amount of drive air, and suction amount of inlet are $Nm^3/hr$ respectively, and that of degree of vacuum is mmHg. Symbol "○" indicate 'better', and "×" indicate 'difficult'.

As will be apparent from Table 1, when the exhaust path 13 is opened, the traction (tension) with respect to the filament decreases but the degree of vacuum at the filament inlet 9*a* of the air gun and the suction amount of air increase, and the introduction of filament to the inlet 9*a* becomes easy.

On the other hand, when the exhaust path 13 is closed, the degree of vacuum at the filament inlet 9*a* of the air gun 30 and the suction amount of air decrease and the introduction of filament to the inlet 9*a* is difficult but since all air flows into the accelerating pipe 4, the traction (tension) with respect to the filament increases.

Accordingly, at the start of operation, when the filament is introduced into the air gun 30, the exhaust path 13 is opened to make the introduction of filament easy. When the filament is drawn after once being introduced, the exhaust path 13 is closed to provide a state in which tension is large.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An air gun for producing nonwoven fabrics having means for facilitating threading of a filament in said gun, comprising;

(I) a first nozzle having a air gun inlet for receiving a filament delivered from a spinning nozzle, including;

(a) a tapered pipeline provided in an interior of said air gun inlet and reduced in diameter up to a middle portion thereof, and (b) a first generally straight pipeline provided in the interior of said air gun inlet, having said same diameter from the middle portion to an extreme end forming the filament outlet, (II) a second nozzle connected to said first nozzle and including;

(a) a blow port encircling a periphery of the extreme end of the first generally straight pipeline, an inner surface of the blow port being gradually reduced in diameter from a blow port air inlet side and then gradually increased in diameter downstream a maximum constriction portion thereof and then forms a second generally straight pipeline having a slightly larger diameter than that of the filament outlet, and (b) a slight clearance formed between the inner surface of said blow port and an outer surface of said extreme end of said first generally straight pipeline, (III) a compressed air inlet communicated with the blow port air inlet of the blow port, and air introduced into the blow port from a compressed air inlet increases in flow velocity to a maximum at a time passing through the maximum constriction portion having the minimum inside diameter whereby air is jetted from the compressed air blow port so as to draw the filament, (IV) a connection pipe connected to the second nozzle in a direction downstream of the maximum constriction portion, (V) an accelerating pipe connected to said connection pipe for guiding the filament, (VI) a carrier path extending through the first nozzle, second nozzle, the connection pipe and the accelerating pipe from the air gun inlet of the first nozzle and having an air flow for transmitting said filament received in said air gun inlet, said filament delivered thereafter and adapted to form said nonwoven fabric, and (VII) an exhaust path branched off from said carrier path on the downstream side from said compressed air blow port for removing a part of the air flowing in the carrier path, and having opening and closing means for facilitating threading of the filament in the carrier path.

2. The air gun for producing nonwoven fabrics according to claim 1, wherein a guide tube is connected to said accelerating pipe.

3. The air gun for producing nonwoven fabrics according to claim 1, wherein said exhaust path is branched off at an angle of 15 to 75 degrees with respect to said carrier path and extends from an exhaust port toward upstream of the carrier path.

4. The air gun for producing nonwoven fabrics according to claim 3, wherein an opening of the exhaust port opened to the carrier path of said exhaust path is in the range of 0.5 mm to 2.0 mm.

5. The air gun for producing nonwoven fabrics according to claim 1, wherein a closing valve is connected to said exhaust path so as to open and close the exhaust path.

6. The air gun for producing nonwoven fabrics according to claims 2, 3, 4, 5 or 1, wherein an air reservoir is connected to said exhaust path so that air from the exhaust path is discharged to the air reservoir.

7. A method for controlling threading a filament by an air gun including;

an inlet for receiving a spun filament from a spinning nozzle, a carrier path having an air flow for transmitting said filament received in said inlet, said filament delivered from said carrier path thereafter and adapted to form nonwoven fabrics, and a compressed air blow port at a predetermined location along said carrier path for jetting air, being fed from a compressed air source into the carrier path, the method comprising the steps of;

providing an exhaust path in said carrier path downstream from said compressed air blow port;

discharging a part of air flowing in the carrier path from said exhaust path through an exhaust port; and turning said air flowing within said exhaust path at an angle of 15 to 75 degrees with respect to said carrier path toward an upstream side of the carrier path.

8. An air gun for producing nonwoven fabrics having means for facilitating threading of a filament in said gun, comprising;

(I) an air nozzle including, (a) an inlet for receiving a spun filament from a spinning nozzle, (b) a carrier path having an air flow for transmitting said filament received in said inlet, said filament delivered thereafter and adapted to form nonwoven fabrics, and (c) a compressed air blow port at a predetermined location along said carrier path for jetting air, being fed from a compressed air source into the carrier path, (II) a connection pipe connected to the air nozzle in a direction downstream of a maximum constriction portion, (III) an accelerating pipe connected to said connection pipe for guiding the filament, (IV) an exhaust path branched off from said carrier path on the downstream side from said compressed air blow port for removing a part of the air flowing in the carrier path, and having opening and closing means for facilitating threading of the filament in the carrier path.

9. The air gun for producing nonwoven fabrics according to claim 8, wherein a guide tube is connected to said accelerating pipe.

10. The air gun for producing nonwoven fabrics according to claim 9, wherein said exhaust path is branched off at an angle of 15 to 75 degrees with respect to said carrier path and extends from an exhaust port toward upstream of the carrier path.

11. The air gun for producing nonwoven fabrics according to claim 10, wherein an opening of the exhaust port opened to the carrier path of said exhaust path is in the range of 0.5 mm to 2.0 mm.

12. The air gun for producing nonwoven fabrics according to claim 9, wherein a closing valve is connected to said exhaust path so as to open and close the exhaust path.

13. The air gun for producing nonwoven fabrics according to any one of claims 8 to 12, wherein an air reservoir is connected to said exhaust path so that air from the exhaust path is discharged to the air reservoir.

* * * * *